US005172455A

United States Patent [19]

Johnson et al.

[11] Patent Number: 5,172,455

[45] Date of Patent: Dec. 22, 1992

[54] BUCKLE AND BELT ASSEMBLY CONSTRUCTION FOR PATIENT RESTRAINT

[75] Inventors: Thomas G. Johnson, Blue Hill; James M. Gruidel; Reinhold A. Haase, both of Hastings, all of Nebr.

[73] Assignee: Dutton-Lainson Company, Hastings, Nebr.

[21] Appl. No.: 765,363

[22] Filed: Sep. 24, 1991

[51] Int. Cl.[5] ..... A44B 11/00

[52] U.S. Cl. ..... 24/170; 24/191; 24/658

[58] Field of Search ..... 24/170, 171, 179, 180, 24/191, 585, 453, 665, 658; 5/62; 297/487, 478, 473, 464, 346, 400; 242/107.4 A

[56] References Cited

U.S. PATENT DOCUMENTS

| | | | |
|---|---|---|---|
| 1,055,440 | 3/1913 | Boden | 24/658 |
| 3,011,237 | 12/1961 | Prete, Jr. | 24/170 |
| 3,678,542 | 7/1972 | Prete, Jr. | 24/170 |
| 3,706,117 | 12/1972 | Axisa | 24/585 |
| 3,735,455 | 5/1973 | Hauser | 24/191 |
| 4,993,127 | 2/1991 | Mechem et al. | 24/453 |

FOREIGN PATENT DOCUMENTS

| | | | |
|---|---|---|---|
| 1204470 | 1/1960 | France | 24/170 |
| 2423175 | 12/1979 | France | 24/170 |
| 0241980 | 9/1946 | Switzerland | 24/585 |

*Primary Examiner*—Victor N. Sakran
*Attorney, Agent, or Firm*—Allegretti & Witcoff

[57] ABSTRACT

An improved buckle construction for coupling a flexible strap to a bushing includes a special buckle cooperative with both a strap that fits through a slot in the buckle and a bushing. The strap is positioned in a through slot in the buckle and engages the head of the bushing positioned in a keyhole in the buckle to bias the bushing into a locked position. The strap is maintained in a locked position in the through slot by means of a biased lever which is manually releasable.

11 Claims, 2 Drawing Sheets

Fig.1
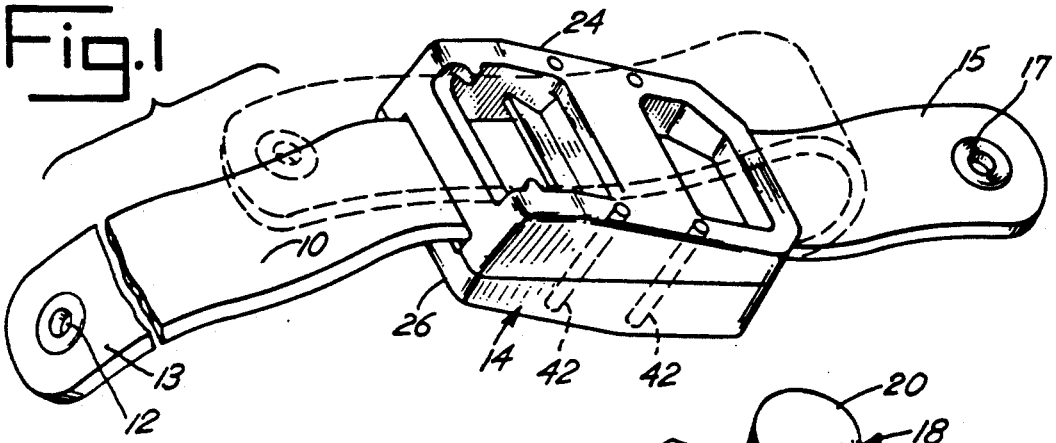
Fig.2
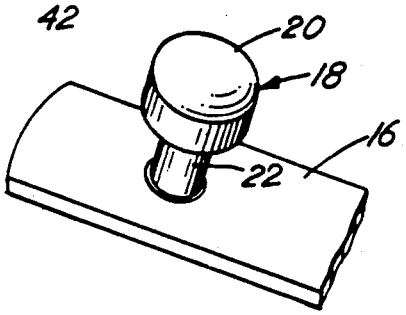
Fig.3
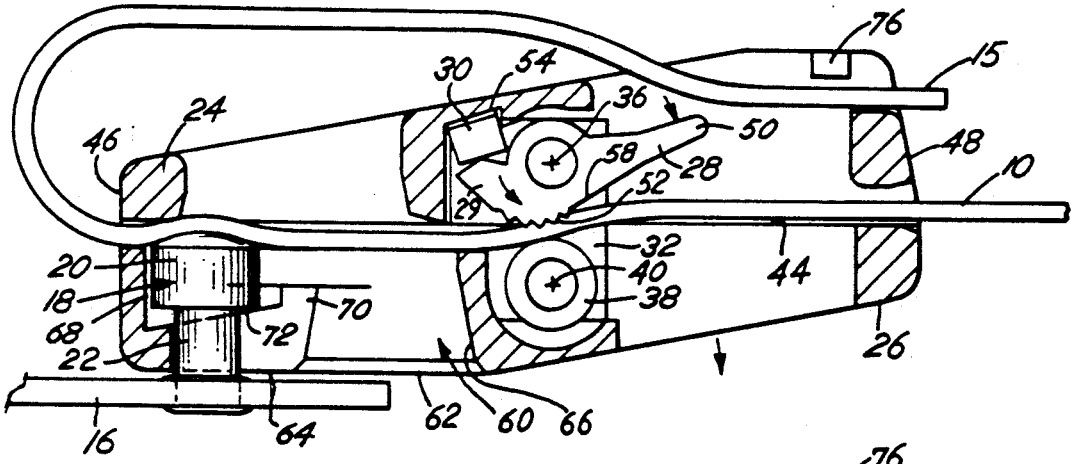
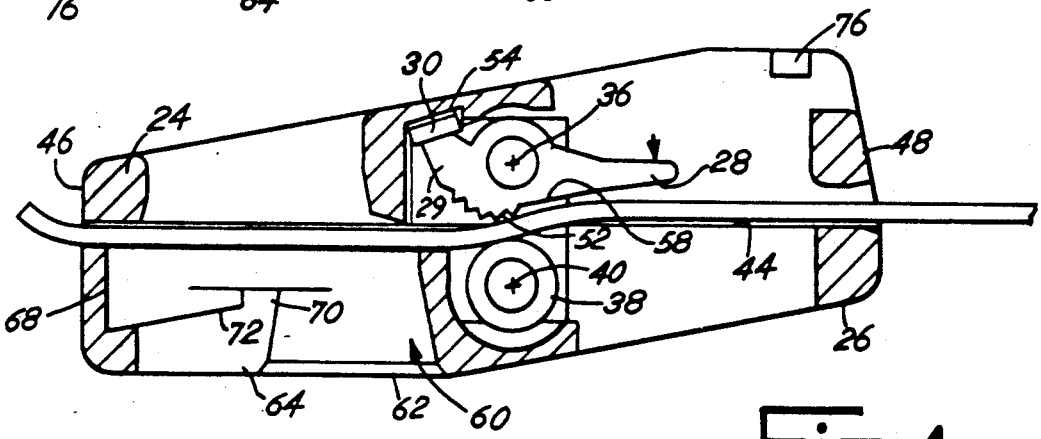
Fig.4

BUCKLE AND BELT ASSEMBLY CONSTRUCTION FOR PATIENT RESTRAINT

BACKGROUND OF THE INVENTION

This invention relates to an improved buckle and belt assembly construction especially useful for patient restraint and support, for example, in a wheel chair.

Patients requiring restraint in a wheel chair, a hospital chair, a bathing tub, a hospital stretcher or a hospital bed are often held or supported in position by means of buckled straps which attach at opposite ends to the chair and fit around and over the patient. Typically, a center buckle, which fastens the free ends of a pair of straps, or attaches a strap to a fixed post or stud, may be manipulated relative to the straps to adjust the tightness of the strap about the patient. Various buckle designs, including standard belt buckle constructions, have been proposed in the past.

Belts and buckles when used to restrain a patient in a bathing tub or a whirlpool bath are subjected to water and various soaps or cleansers or other solutions. As such the belts and buckles must be kept clean and disinfected, which is especially difficult with open weave material belts and with some buckle designs. Further, certain materials, such as metal may cause patient discomfort because they feel cold or hot when touching the bare skin of a patient. Thus, features desired with respect to a buckle and strap assembly include ease of removal from around a patient, ease of adjustment of tightness, maintenance of appropriate tightness, use of few moveable or moving parts, few pinch points, sanitary constructions, rugged construction and economical construction. Further, a buckle and belt construction should also be easily cleaned and comfortable. These goals, among others, inspired the development of the present invention.

SUMMARY OF THE INVENTION

In a principle aspect, the present invention comprises an improved buckle and belt assembly. The assembly includes a buckle for coupling a flexible belt strap to a bushing, post or stud preferably attached to the patient chair, stretcher or the like or alternatively to the end of another strap. The buckle includes a body member molded or formed from a rigid material and with an elongated slot therethrough for receipt of one end of a first strap. The body member also includes a keyhole shaped passage adapted to receive and retain the bushing, which is attached to a support member in the preferred embodiment. A manually actuable locking lever is mounted in the body member and normally engages the flexible strap to retain the strap in a position where it is moveable only in one direction—i.e. a direction which will permit tightening of the strap. Actuation of the lever will release the directional locking mechanism for the strap. The flexible strap fits through the slot in the body member and against the head of a bushing inserted into the keyhole in such a manner that will bias or wedge the bushing into locking engagement with the keyhole opening. The body member also includes tab members which can receive the free end of a strap and hold it over the buckle to protect the buckle lever release mechanism from accidental engagement, and to keep the end of the belt away from interference with any patient chair mechanism and further to preclude interference of the strap with the patient during bathing, for example.

Thus, it is an object of the invention to provide an improved buckle and belt assembly especially useful for patient support and restraint.

It is a further object of the present invention to provide an improved buckle construction comprising a body member which grips one strap and is cooperative with a fixed bushing wherein the bushing is biased into cooperation with the buckle by the flexible strap that also serves to restrain patient movement.

A further object of the invention is to provide an improved buckle and belt assembly which is easily adjustable and which can be adjusted for tightness merely by pulling on a strap in one direction but which restrains movement of the strap in the opposite direction.

Yet a further object of the invention is to provide a belt buckle construction which resists movement of the strap from the buckle and which also includes a means for release of the mechanism which restrains movement of the strap.

Yet a further object of the invention is to provide an improved buckle construction having a keyhole slot for receipt of a bushing where the shape and configuration of the slot are unique in order to facilitate easy release of the bushing by means of straightforward manual manipulation of the buckle.

A further object of the invention is to provide an improved buckle and belt assembly construction which is economical to manufacture and which may be utilized in combination with pre-existing patient furniture such as stretchers, lifts, wheel chairs and the like.

Another object of the invention is to provide an improved buckle and belt assembly which is ruggedly constructed and which can be easily replaced and repaired.

One further object of the invention is to provide an improved buckle assembly that is cooperative with a flexible strap that retains or restrains a patient wherein the strap is also utilized to lock the belt buckle and may be further utilized to protect the buckle from inadvertent release by providing a biasing force for engagement with a bushing.

Another object of the invention is to provide a belt and buckle assembly which can be easily cleaned and maintained.

Another object of the invention is to provide a buckle construction which is economical to manufacture and purchase.

These and other objects, advantages and features of the invention will be set forth in a detailed description which follows.

BRIEF DESCRIPTION OF THE DRAWING

In the detailed description which follows a reference will be made to the drawing comprised of the following FIGURES:

FIG. 1 is a perspective view of the improved buckle and belt assembly;

FIG. 2 is a perspective view of the bushing and strap assembly of FIG. 1;

FIG. 3 is a cross-section of the buckle body illustrating the manner in which the bushing fits within the body and is retained therein by means of the strap;

FIG. 4 is a cross-section of the buckle similar to FIG. 3 wherein the strap release lever has been actuated to release the strap for movement in either direction.

DESCRIPTION OF THE PREFERRED EMBODIMENT

Figure 5:
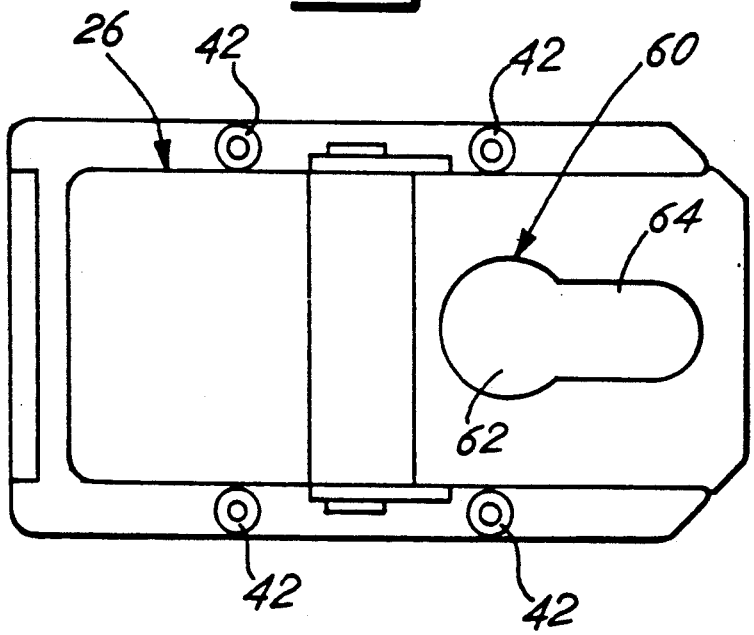
FIG. 5 is a plane view of the surface of the buckle body member depicting the shape of the keyhole opening therein.

FIGS. 1 and 2 illustrate the assembly which comprises the improved belt and buckle construction of the present invention. A flexible web or strap 10 is attached at one end (not shown) to the side of a chair or stretcher or some other patient carrier. The strap 10 may be of a woven fabric or fiber. However, a smooth, coated or sealed strap is preferred since it is easier to clean and disinfect. The grommeted opening 12 is designed to engage a post or bushing (not shown) on the patient carrier and thus to fasten one end of strap 10. The opposite end 15 of strap 10 has a uniform width and thickness and is flexible so that it may fit around and support a patient. A second smaller grommeted opening 17 in the loose end 15 prohibits removal of the belt from the buckle and prevents inadvertent, improper reassembly in the field. The strap 10 terminates with an end 13 and a grommeted opening 12. The strap 10 cooperates with a buckle body member 14 as described in greater detail below. A second strap 16 of similar size, shape and flexible material supports an attached bushing 18. The bushing 18 has a head 20 which has a diameter greater than that of a neck 22 or a stem 2 which attaches to the strap 16. The bushing 18 is thus affixed to the second strap 16 at the stem 22. Alternatively and preferably bushing 18 is rigidly affixed to the patient carrier, e.g. bushing 18 is fixed to the metal arm or side rail of a wheelchair or stretcher.

Thus, the bushing 18 cooperatively engages with the body member 14 so that the straps 10 and 16 are joined or connected, or the body member 14 cooperates with a bushing 18 mounted rigidly on a carrier. In this manner a patient restraining loop is formed. The strap 10 is slidable through the body member 14 to thereby permit adjustment of the tightness of the restraining loop defined by strap 10 or connected straps 10 and 16. Consequently, when the body member 14 is cooperatively engaged with the bushing 18, the end 15 of the strap 10 may be pulled to tighten the assembly. The end 15 of the strap 10 may then be folded over as depicted in dotted lines in FIG. 1 to be retained by the body member 14 and thereby restrict access to certain mechanical release features of the buckle body member 14. Thus, the strap 10 can be stressed or pulled to the right in FIG. 1 as the strap 16 pulls to the left with the separate straps 10 and 16 joined together by means of the cooperating bushing 18 and body member 14. Again, strap 16 is not required or included if bushing 18 is attached directly to the patient carrier.

The body member 14 is illustrated in greater detail in the remaining FIGS. 2 through 7. The body member 14 includes an outer or outside molded body section 24 and inside body section 26. Both of the body sections 24 and 26 are manufactured from a molded plastic although other materials may be used as desired.

Retained within the body member 14 is a biased, manually actuable, locking lever 28. A leaf spring 30, retained between support plates 32 and 34, acts against an extension 29 of arm 28 to bias the arm 28 in the counterclockwise direction in FIGS. 2 and 3. The lever arm 28 pivots about an axis 36 that extends between the support plates 32 and 34, which are captured between the sections 24, 26 and which are positioned in cavities on opposite sides of the region which receives the strap 10. The plates 32 and 34 also support a cylindrical roller 38 for rotation about an axis 40 parallel to axis 36 and spaced from axis 36 on the opposite side of the elongated slot 44 through body member 14.

The body sections 24 and 26 are molded so that they can fit together and be retained together by connecting pins or fasteners 42 at each corner (see FIG. 1). The body sections 24 and 26 are molded to define an elongated center slot 44 which extends from one end 46 of the assembled body member 14 to the opposite end 48. The slot 44 has a width slightly greater than the width of the web or belt or strap 10 and a thickness which is also slightly greater than that of the strap 10. Thus, the strap 10 can move conveniently through the slot 44 from one end 46 to the opposite end 48.

Positioned in the middle portion of the body member 14 is the locking lever 28. The locking lever 28 includes a manual drive bar 50. It also includes serrations or teeth 52 which normally project into the slot 44. That is, the biasing leaf spring 30 is retained in a molded pocket 54 in the body section 26. The leaf spring 30, as depicted in FIG. 3, biases the extension 29 and thus the lever arm 28 about the axis 36 so that the teeth 52 will engage against the strap 10. An arrow pointing downward on lever arm 50 in FIG. 3 indicates the direction of the biasing force.

In opposed relation to the lever arm 50 is the roller 38. The roller 38 rotates about the axis 40 in order to maintain the strap 10 tightly against the teeth 52. Thus, the spacing of the teeth 52, when in the position shown in FIG. 3, from the roller 38, and more particularly the surface of the roller 38, is less than the thickness of the strap 10. In this manner the strap 10 is gripped and movement of the strap to the right in FIG. 3 is precluded due to the engagement of the teeth 52 therewith. Note, however, that movement of the strap 10 to the left in FIG. 3 is permitted since pulling on the strap 10 to the left causes the lever arm 28 to move clockwise and disengage the strap 10. Thus, the strap 16 may be moved uni-directionally to the left in FIG. 3. It cannot move to the right, however, since it is engaged and held in position by the teeth 52 cooperating with the roller 38.

With the construction depicted in the FIGURES, however, it is possible to release engagement of teeth 52 with the strap 10 by manual activation of lever arm 28. This is accomplished by manually depressing the bar 50 in a clockwise direction as depicted in FIG. 3 to rotate the arm 28 about its axis 36 against the force of the biasing spring 30. This causes the teeth 52 to be rotated up out of the region of the slot 44 and out of engagement with the strap 10 as depicted in FIG. 4. The strap 10 then is confronted only by the smooth surface of the roller 38 and the smooth surface 58 associated with the lower part of the arm 28. The strap 10 may then be manually moved in either direction.

Referring again to the FIGURES, a keyhole shaped slot 60 is defined in the inside body section 26. The keyhole slot 60 has a keyhole configuration as depicted in FIG. 5 which includes a circular portion 62 connected with an elongated slot portion 64 having a width less than the diameter of the circular portion 62. The elongated slot portion 64 has a width substantially equal to or slightly greater than the diameter of the neck or stem 22 of bushing 18. The circular portion 62 has a diameter which is greater than the diameter of the head 20 so that the head 20 may be inserted into a frustoconical, primary passage 66 defined in the body section 26. The frustoconical passage is sized for receipt of the head 20. Note, the passage 66 connects with an enlarged secondary passage 68 which is separated from the primary passage 66 by lugs 70 on the inside of the body member 14. The secondary passage 68 has a diameter and configuration similar to that of the primary passage 66 and is sized so that the head 20 will fit therein. The secondary passage thus has a diameter greater than the width of the slot 64.

When the head 20 slides to the left in FIG. 3, it will pass over the lugs 70. The stem 22 will easily slide in the slot portion 64. The head 20, however, cannot pass vertically downward through the slot portion 64. The head 20 is also retained by the lug 70. Importantly, the head 20 is also biased into the pocket or secondary cavity 68 by the flexible strap 10 which acts as a biasing means or spring to hold that head 20 in position within the slot 64. The tolerances of the head 20, and the depth of the secondary cavity 68 are such that the head 20 is effectively biased into a tight engagement within the pocket 68.

Bushing 18 is typically and preferably mounted on a rod, tube or frame member (not shown) which defines a support member of the hospital chair, stretcher or the like. Thus the bushing 18 is affixed to the frame member of the chair in a manner that permits pivoting of the buckle about the rod, tube or frame member for attachment of or removal from the bushing 18.

Note, the pocket 68 has an inclined, inner surface 72 which tends to operate to retain the head 20 in position so that the body member 14 may pivot about the head 20 in the clockwise direction as exhibited in FIG. 3 and thus the underside of the head 20 is retained tightly in a flat position against the surface 72. In this manner, the buckle and bushing construction articulate and can fit against a rounded surface such as the outside body of a patient. The head 20 is thus retained tightly and evenly within the secondary pocket 68. It is important to note that in order to remove buckle 14 from bushing 18, it is necessary to first rotate the buckle clockwise about the bushing, and then to slide the buckle to the left while rotating counter clockwise due to the design discussed above, and the overhang of the strap 10. The attachment of the buckle to the bushing requires the opposite motion. This is a natural motion, easy to accomplish, but one that is unlikely to occur as a result of pulling on the loose end of strap 10, thereby minimizing the potential for accidental disengagement while tightening the strap. Also note that the frustoconical shape of primary passage 66 discussed above is important and is used rather than a simple cylindrical shape, to avoid a possible false connection between buckle 14 and bushing 18. If a proper connection between the two is not made, a slight pull on belt 10 in either direction is sufficient to completely disengage the two, making the condition obvious and avoiding a false sense of security.

The end 15 of the strap 10 which projects from the slot 44 may be folded up over the outside surface of the body member 14 to be retained by lugs 76 projecting toward each other at the one end of the body member 14 on the outside surface thereof. This secures the loose end of the strap so that it does not interfere with any of the mechanical elements of the chair and also does not interfere with the bathing process when used in a bath or tub. The strap 10 will also cover and protect the lever arm 28 from access. This will prevent the patient from accidentally loosening or disconnecting the buckle assembly. Thus, when loosening the strap 10, it is necessary to remove the end 15 from engagement from the lug 76 in order to have access to the lever 28 and more particularly arm 50.

In sum, the buckle construction provides a secure grip on a coated webbing belt or strap 10 and precludes movement in one direction while allowing free movement in the other direction. The locked buckle can be released, however, by actuation of the lever arm 50. The buckle construction is designed to provide a straight, through passage to avoid severe kinking or bending of the strap 10. Advantage is taken of the flexibility of the belt 10, since it acts as a biasing force against the bushing 18 to help retain the bushing in position. The lug 70 and the secondary pocket 68 as well as the associated surface 72 of the pocket 68 are arranged in a configuration or angle to the facilitate retention of the bushing within the pocket 68.

With the construction of the present invention, the number of moving parts associated with the buckle is a minimum. By appropriately choosing the dimensions of the bushing 18, the pocket 68, the lug 70 and the primary passage 66 it is possible to design a keyhole slot 60 which facilitates retention of the bushing 18, yet permits removal thereof by appropriate tilting and maneuvering. Tightening of the buckle tends to cause the buckle to move snugly against the body of the patient causing the body 14 to tilt in the manner previously described, thereby retaining the bushing 18 in the pocket 68. The frustoconical shape of the passage 66 further facilitates insertion of the bushing 18 into engagement with the buckle as described.

While there has been set forth the preferred embodiment of the invention, it is to be understood that the invention is to be limited only by the following claims and their equivalents.

What is claimed is:

1. An improved belt buckle construction for coupling a flexible belt strap to a bushing, of the type having a head and a stem, said construction comprising:

a rigid material buckle body member having an outside surface, an inside surface and opposite ends with an elongated slot through the body connecting the ends, said slot sized to receive the flexible belt strap therethrough from end to end;

a keyhole shaped passage extending from the inside surface toward the through slot, said passage including means for retention of the bushing comprising a wide section for receipt of the head of a bushing and a narrow section for receipt of the stem of a bushing, said narrow section defined adjacent the inside surface and connected with a wide retaining section adjacent the elongated slot for slidable receipt of the head, said retaining section having a depth less than the thickness of the head, whereby a flexible belt strap in the slot biases against the head toward the narrower section to hold the stem in the narrower section of the passage and also holds the head in the wide retaining section; and a releasable belt strap engaging means retained within the buckle body member adjacent the keyhole passage for holding the strap in a generally non-slidable position in at least one direction through the elongated slot.

2. The construction of claim 1 wherein the narrower section of the keyhole shaped passage is adjacent one end of the buckle body, and wherein the belt strap engaging means precludes slidable movement of a flexible belt toward the opposite end of the buckle body.

3. The construction of claim 1 wherein the belt strap engaging means includes means for releasing the engaging means.

4. The construction of claim 1 wherein the head and stem are generally cylindrical with the diameter of the stem less than the diameter of the head, and wherein the keyhole slot is comprised of a first portion adjacent the inside surface with a wide section having a cylindrical shape and size slightly greater than the diameter of the head, and wherein the narrower section is connected thereto and has a width slightly greater than the diameter of the stem, but less than the diameter of the head, said slot also comprised of a second position having first and second wide sections substantially identical in diameter to the side section of the first portion separated by opposed tabs extending toward each other from the sides of the slot, said first wide section aligned with the first portion wide section, said second wide section overlying part of the narrower section, said slot further comprised of a third portion of generally uniform width equal to the diameter of the side sections, whereby the head fits into the wide section from the inside surface and is slidable over the tabs for retention in the second wide section of the second portion.

5. The construction of claim 1 wherein the belt engaging means comprises a toothed locking lever biased into engagement with a belt strap in the slot, said lever being pivotal about an axis generally parallel to the surface of the strap.

6. An improved belt buckle construction including a buckle and cooperative bushing, said construction comprising, in combination:

a bushing having a head supported on a stem, the head having a thickness, said head and stem having a transverse dimension, the transverse dimension of the head exceeding the transverse dimension of the stem;

a separate buckle body member having a bottom side, a top side, opposite ends, a through slot for a flexible strap between the opposite ends, and a keyhole slot in the bottom side for receipt of the bushing, said slot including means for retention whereby the head may project into the slot toward the top side for coaction with a flexible strap in the through slot to assist in maintaining the bushing cooperatively engaged with the buckle; and a locking lever mounted in the body member, said locking lever rotatably mounted on an axis transverse to the sides of the body member and spaced from one side of the slot;

biasing means mounted in the body member cooperative with the lever to bias the lever in a first rotatable direction for engagement with a flexible strap positioned in the slot, said lever including teeth for gripping a flexible strap and an arm for pivoting the lever against the force of the biasing means to thereby rotate the teeth out of opposition for engagement with a flexible strap.

7. The construction of claim 6 including a roller mounted in the body member in opposed relation to the locking lever on the opposite side of a flexible strap.

8. The construction of claim 6 including gripping tabs projecting from the body member for retention of a flexible strap.

9. The construction of claim 6 wherein the keyhole slot includes an internal pocket defined within the body member for slidable receipt and retention of the bushing head.

10. The construction of claim 9 further including at least one retaining tab within the keyhole slot for retaining the head in the pocket.

11. The construction of claim 9 wherein the flexible strap slot intersects with the keyhole slot whereby a flexible strap will bias the head of the bushing into the pocket.

* * * * *